US005665498A

United States Patent [19]

Savage et al.

[11] Patent Number: 5,665,498

[45] Date of Patent: Sep. 9, 1997

[54] IMAGING ELEMENT CONTAINING POLY(3, 4-ETHYLENE DIOXYPYRROLE/STYRENE SULFONATE)

[75] Inventors: Dennis J. Savage, Rochester; Brian A. Schell, Honeoye Falls; Brian K. Brady, North Chili, all of N.Y.

[73] Assignee: Eastman Kodak Company, Rochester, N.Y.

[21] Appl. No.: 753,306

[22] Filed: Nov. 22, 1996

[51] Int. Cl.[6] ..... G03G 5/14; G03C 1/85

[52] U.S. Cl. ..... 430/41; 430/62; 430/66; 430/529; 503/200; 346/135.1

[58] Field of Search ..... 430/41, 62, 66, 430/529, 531, 634; 503/200; 346/135.1

[56] References Cited

U.S. PATENT DOCUMENTS

| | | | |
|---|---|---|---|
| 3,681,070 | 8/1972 | Timmerman et al. | 430/62 |
| 5,096,975 | 3/1992 | Anderson et al. | 430/529 |
| 5,364,752 | 11/1994 | Timmerman et al. | 430/529 |
| 5,478,685 | 12/1995 | Nogami et al. | 430/62 |

FOREIGN PATENT DOCUMENTS

| | | | |
|---|---|---|---|
| 62-296152 | 12/1987 | Japan | 430/62 |
| 7007060 | 11/1970 | Netherlands | 430/62 |

*Primary Examiner*—Roland Martin
*Attorney, Agent, or Firm*—Carl F. Ruoff

[57] ABSTRACT

An imaging element such as a photographic, electrostatic, or thermal imaging element is comprised of a support, an image-forming layer, and a transparent electrically conductive layer which includes an effective amount of poly(3,4-ethylene dioxypyrrole/styrene sulfonate). In a preferred embodiment, the poly(3,4-ethylene dioxypyrrole/styrene sulfonate) is dispersed in a polymeric binder.

18 Claims, No Drawings

IMAGING ELEMENT CONTAINING POLY(3, 4-ETHYLENE DIOXYPYRROLE/STYRENE SULFONATE)

FIELD OF THE INVENTION

The present invention relates in general to imaging elements, such as photographic, electrostatographic, ink jet and thermal imaging elements, and in particular to imaging elements comprising a support, an image-forming layer and a transparent electrically-conductive layer.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent of the temperature and relative humidity in their environment. At low humidities and temperatures, the diffusional mobilities of the ions are greatly reduced and conductivity is substantially decreased.

At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827; U.S. Pat. No. 5,204,219) along with an optional alkali metal orthosilicate to minimize 10ss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 μm in size in an insulating film-forming binder, exhibiting a surface resistivity. of $10^2$ to $10^{11}$ ohms per square. The conductivity of these coatings is substantially independent of the relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $106^{-1}cm^{-1}$) which are typically about three orders of magnitude greater than is observed for similar thickness films containing crystalline vanadium pentoxide particles. In addition, low surface resistivities can be obtained with very low vanadium pentoxide coverage. This results in low optical absorption and scattering losses. Also, the thin films are highly adherent to appropriately prepared film bases. However, vanadium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O5$— are alleged to be useful as antistatic agents in photographic elements or as conductive agents in electrostatographic elements in such patents as U.S. Pat. Nos. 4,275,103, 4,394,441, 4416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.1–10 $g/m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 μm) particles in order to minimize light scattering (haze) by the antistatic layer.

Antistatic layers comprising electroconductive ceramic particles, such as particles of TiN, $NbB_2$, TiC, $LaB_6$ or MOB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive particles in an electro-conductive coating to achieve effective antistatic performance can result in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

It is toward the objective of providing improved electrically-conductive layers that more effectively meet the diverse needs of imaging elements—especially of silver halide photographic films but also of a wide range of other imaging elements—than those of the prior art that the present invention is directed.

SUMMARY OF THE INVENTION

The present invention is an imaging element which includes a support, at least one image-forming layer superposed on said support, and a transparent electrically conductive layer superposed on the support. The electrically conductive layer is a dispersion of poly(3,4-ethylene dioxypyrrole/styrene sulfonate) in a film-forming binder.

In addition the present invention is an imaging element which includes a support, at least one image-forming layer superposed on said support, a transparent electrically conductive layer superposed on the support, and a protective overcoat over the electrically conductive layer. The electrically conductive layer is a dispersion of poly(3,4-ethylene dioxypyrrole/styrene sulfonate).

DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly (vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation induced discharge of a uniform potential peviously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly (ethylene terephthalate) as described in U.S. Pat. No. 3,245,833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure*, June 1978, Item No. 17029; U.S. Pat. Nos. 3,457,075; 3,933,508; and 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gunditch, "Xeroprinting Master with Improved Contrast Potential", *Xerox Disclosure Journal*, Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng,. and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography*, (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. Nos. 4,343,880 and 4,727,008.

In the imaging elements of this invention, the image-forming layer can be any of the types of image-forming layers described above, as well as any other image-forming layer known for use in an imaging element.

Methods of preparing imaging elements are well known in the art. For example, the preparation of single and multi imaging elements is described in *Research Disclosure* 308119, dated December, 1989, the disclosure of which is incorporated herein by reference.

Typical photographic elements (materials, supports, etc. useful in the preparation thereof), in which the coating composition of this invention can be incorporated are disclosed in above-noted *Research Disclosure* 308119, incorporated herein by reference.

The support for the image-forming elements of this invention can be coated with a magnetic recording layer as discussed in *Research Disclosure* 34309 of November, 1992, the disclosure of which is incorporated herein by reference.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging element of the present invention contains at least one electrically conductive layer which comprises a dispersion of poly(3,4-ethylene dioxypyrrole/styrene sulfonate) in an amount sufficient to provide antistatic properties to the electrically conductive layer. The electrically conductive layer preferably contains a film forming binder. It is also possible to overcoat the electrically conductive layer to insure process survivablity. Suitable overcoats are described in U.S. Pat. Nos. 5,221,598 and 5,006,451. These patents describe protective barrier layers which include latex polymers and polyacrylamide polymers having a hydrophilic functionality.

Binders useful in antistatic layers include: water-soluble polymers such as gelatin, gelatin derivatives, maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acid esters; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, Vinyl and vinylidene halides, olefins, and aqueous dispersions of polyurethanes or polyesterionomers.

The present invention will now be described in detail by reference to the following examples.

EXPERIMENTAL 3,4-ethylene dioxypyrrole (EDP) was synthesized in six steps by a modification of the procedure of S. Merz et. al., Synthesis, 795 (1995).

Polymerization of 3,4-ethylene dioxypyrrole with Polystyrene Sulfonic Acid.

A mixture of polystyrene sulfonic acid (45 ml, 20% solution in water, MW=70,000, Scientific Polymer Products, Inc.), ammonium persulfate (1.62 g, 7 mmol), and 3,4-ethylene dioxypyrrole (2.2 4 g, 18 mmol) in 400 ml distilled water under argon atmosphere was stirred for 24 hours at room temperature. The initially dark brown reaction mixture turned brown-black as the reaction progressed. This dispersion can be coated directly or preferably dialyzed before coating.

COATING AND EVALUATION

Several coating combinations of poly (3,4-ethylene dioxypyrrole-styrene sulfonate) and various film-forming binders were evaluated. Surface electrical resistivity was measured with a Trek Model 150 surface resistivity meter (Trek, Inc., Medina, N.Y.) according to ASTM standard method D257–78.

To test the conductivity of the coatings after exposure to photographic processing chemistries, the coatings were immersed in baths of developer solutions (Eastman Kodak, C-41 developer) for 15 seconds at room temperature. They were rinsed with deionized water for 5 seconds and then dried. The surface electrical resistivities of the coatings were measured again, as above.

All of the examples shown below were coated from aqueous solutions of poly (3,4-ethylene dioxypyrrole-styrene sulfonate) blended with the various binders or in some cases the poly(3,4-ethylene dioxypyrrole-styrene sulfonate) was coated with no binder polymer. All were coated onto polyethylene terephthalate support that was subbed with a terpolymer of acrylonitrile/vinylidene chloride/acrylic acid as is well known in the art. All of the coatings were clear with little or no color. Other support materials and/or alternative subbing chemistries could be chosen, for example, paper, cellulose acetate, polyethylene naphalate (PEN), CDT as a subbing, etc. The coatings were made either with wire-wound rods or x-hopper coating machines, but any commonly known coating method could be employed. Surfactants, defoamers, leveling agents, matte particles, lubricants, crosslinkers, or other addenda could also be included in such coating formulations as necessitated by the coating method or the end use of the coatings.

The examples below represent a wide range of polymeric binders and it can be assumed that other film forming materials would be equally usable in combination with poly(3,4-ethylene dioxypyrrole-styrene sulfonate). For improved abrasion resistance or other special applications, coatings such as have been described here can be overcoated with materials known in the art; for example methacrylates, polyacrylates, polyurethanes, etc. as well as magnetic oxides in polymeric binders.

| Binder | Wt % Poly(3,4-ethylene dioxypyrrole-styrene sulfonate | Total Dry Coverage, g/m$^2$ | surface resistivity log-ohm/□ before C-41 immersion | surface resistivity log-ohm/□ after C-41 immersion |
|---|---|---|---|---|
| Polymer A | 30 | 1.1 | 7.7 | 9.8 |
| Polymyr B | 30 | 1.1 | 8.4 | 10.2 |
| Polymer C | 30 | 1.1 | 6.9 | 9.1 |
| Polymer D | 30 | 1.1 | 7.8 | 9.8 |
| Polymer E | 30 | 1.1 | 8.3 | 10.0 |
| No Binder | 100 | 0.03 | 8.0 | >12 |
| No Binder | 100 | 0.11 | 6.0 | 9.8 |

Polymer A: Terpolymer of Styrene/n-Butyl Methacrylate/2-Sulfobutyl Methacrylate, sodium salt (30/60/10)

Polymer B: Terpolymer of Acrylonitrile/Vinylidene Chloride/Acrylic Acid

Polymer C: Terpolymer of n-Butyl Acrylate/2-Hydroxyethyl Methacrylate/Methyl 2-acrylamido-2-methoxyacetate (60/15/25)

Polymer D: Commercially available sulfonated polyester AQ29, Eastman Chemical

Polymer E: Commercially available sulfonated polyester AQ55, Eastman Chemical

The examples describe the wide range of polymeric binders which may be successfully used in combination with the 3,4-ethylene dioxypyrrole-polystyrenesulfonate. In addition, the examples demonstrate the potential usefulness in combination with such binders for improved chemical resistance.

The invention has been described in detail with particular reference to certain preferred embodiments thereof, but it will be understood that variations and modifications can be effected within the spirit and scope of the invention.

What is claimed is:

1. An imaging element comprising a support, at least one image-forming layer superposed on said support;

a transparent electrically conductive layer superposed on said support comprising a dispersion of poly(3,4-ethylene dioxypyrrole/styrene sulfonate) in a film-forming binder.

2. The imaging element according to claim 1, wherein the film-forming binder comprises gelatin.

3. The imaging element according to claim 1, wherein the film-forming binder comprises a vinylidene chloride-based terpolymer latex.

4. The imaging element according to claim 1, wherein the support is selected from the group consisting of cellulose nitrate film, cellulose acetate film, poly(ethylene terephthalate) film, poly(ethylene naphthalate) film, polystyrene film, polycarbonate film, glass metal, paper and polymer-coated paper.

5. An imaging element comprising a support, at least one image-forming layer superposed on said support;

at least one transparent magnetic layer superposed on said support;

a transparent electrically conductive layer superposed on said support comprising a dispersion of poly(3,4-ethylene dioxypyrrole/styrene sulfonate) in a film-forming binder.

6. The imaging element according to claim 5, wherein the film-forming binder comprises gelatin.

7. The imaging element according to claim 5, wherein the film-forming binder comprises a vinylidene chloride-based terpolymer latex.

8. The imaging element according to claim 5, wherein the support is selected from the group consisting of cellulose nitrate film, cellulose acetate film, poly(ethylene terephthalate) film, poly(ethylene naphthalate) film, polystyrene film, polycarbonate film, glass metal, paper and polymer-coated paper.

9. An imaging element comprising a support, at least one image-forming layer superposed on said support;

a transparent electrically conductive layer superposed on said support comprising a dispersion of poly (3,4-ethylene dioxypyrrole/styrene sulfonate); and a protective overcoat over said electrically conductive layer.

10. The imaging element according to claim 9, wherein the support is selected from the group consisting of cellulose nitrate film, cellulose acetate film, poly(ethylene terephthalate) film, poly(ethylene naphthalate) film, polystyrene film, polycarbonate film, glass metal, paper and polymer-coated paper.

11. The imaging element according to claim 9, wherein the protective overcoat layer comprises latex polymers and polyacrylamide polymers having a hydrophilic functionality.

12. An imaging element comprising a support, at least one image-forming layer superposed on said support;

at least one transparent magnetic layer superposed on said support;

a transparent electrically conductive layer superposed on said support comprising a dispersion of poly(3,4-ethylenedioxypyrrole/styrene sulfonate); and a protective overcoat over said electrically conductive layer.

13. The imaging element according to claim 12, wherein the support is selected from the group consisting of cellulose nitrate film, cellulose acetate film, poly(ethylene terephthalate) film, poly(ethylene naphthalate) film, polystyrene film, polycarbonate film, glass metal, paper and polymer-coated paper.

14. The imaging element according to claim 12, wherein the protective overcoat layer comprises latex polymers and polyacrylamide polymers having a hydrophilic functionality.

15. An imaging element comprising a support, at least one image-forming layer superposed on said support; and a transparent electrically conductive layer superposed on said support comprising a dispersion of poly(3,4-ethylene dioxypyrrole/styrene sulfonate).

16. The imaging element according to claim 15, wherein the support is selected from the group consisting of cellulose nitrate film, cellulose acetate film, poly(ethylene terephthalate) film, poly(ethylene naphthalate) film, polystyrene film, polycarbonate film, glass metal, paper and polymer-coated paper.

17. An imaging element comprising a support, at least one image-forming layer superposed on said support;

at least one transparent magnetic layer superposed on said support; and a transparent electrically conductive layer superposed on said support comprising a dispersion of poly(3,4-ethylenedioxypyrrole/styrene sulfonate).

18. The imaging element according to claim 17, wherein the support is selected from the group consisting of cellulose nitrate film, cellulose acetate film, poly(ethylene terephthalate) film, poly(ethylene naphthalate) film, polystyrene film, polycarbonate film, glass metal, paper and polymer-coated paper.

* * * * *